US005232823A

United States Patent [19]

Morimoto et al.

[11] Patent Number: 5,232,823

[45] Date of Patent: Aug. 3, 1993

[54] METHOD FOR DEVELOPMENT OF SILVER HALIDE LIGHT-SENSITIVE BLACK AND WHITE MATERIAL

[75] Inventors: Kiyoshi Morimoto; Takashi Toyoda, both of Kanagawa, Japan

[73] Assignee: Fuji Photo Film Co. Ltd., Kanagawa, Japan

[21] Appl. No.: 762,114

[22] Filed: Sep. 19, 1991

[30] Foreign Application Priority Data

Sep. 19, 1990 [JP] Japan ..... 2-249415
Jan. 10, 1991 [JP] Japan ..... 3-012454

[51] Int. Cl.[5] ..... G03C 5/18

[52] U.S. Cl. ..... 430/438; 430/441; 430/445; 430/456; 430/487; 430/489; 430/611; 430/963

[58] Field of Search ..... 430/445, 487, 489, 963, 430/611, 438, 441, 456, 487

[56] References Cited

U.S. PATENT DOCUMENTS 4,789,627 6/1988 Inoue et al. ..... 430/445
4,886,738 12/1989 Deguchi et al. ..... 430/611
5,057,402 10/1991 Shiba et al. ..... 430/611

*Primary Examiner*—Charles L. Bowers, Jr.
*Assistant Examiner*—James Pasterczyk
*Attorney, Agent, or Firm*—Sughrue, Mion, Zinn, Macpeak & Seas

[57] ABSTRACT

Disclosed is a method for the development of a silver halide light-sensitive black and white material, wherein a silver halide light-sensitive material is developed in the presence of at least one compound represented by the following general formula (I):

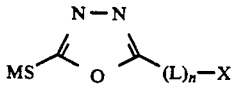

(I)

wherein M represents a hydrogen atom, an alkali metal atom, an ammonium group or a group which is cleaved under alkaline conditions; L represents a bivalent organic group comprising an alkylene group, an alkenylene group, an ether group, a thioether group, —CO—, —CS— or —NR— (wherein R represents a hydrogen atom or an alkyl group) alone or a combination of two or more of them; X represents an amino group, an ammonio group, a hydroxyl group or a heterocyclic group; and n represents 0 or 1.

6 Claims, No Drawings

METHOD FOR DEVELOPMENT OF SILVER HALIDE LIGHT-SENSITIVE BLACK AND WHITE MATERIAL

FIELD OF THE INVENTION

This invention relates to a method for the development of a silver halide photographic material and more particularly to a method for rapidly processing photographic material.

BACKGROUND OF THE INVENTION

The demand for rapid processing in the development of silver halide photographic materials has increased in recent years. In carrying out rapid processing, the development temperature is generally raised to shorten development time. However, when high-temperature processing (e.g., at a temperature of not lower than 40° C.) is conducted, the oxidation reaction of developing solutions with air is accelerated or the developing solutions are concentrated by evaporation. As a result, the compositions of the developing solutions ar greatly changed and it is difficult to maintain the photographic characteristics of fresh solutions. Thus, this method is not preferable.

Other methods for increasing development activity in carrying out rapid processing include a method wherein the amount of developing agents is increased and a method wherein the pH of the developing solutions is increased. In the method wherein the amount of the developing agents is increased, the amount of sulfites for use in stabilizing the developing solutions must be increased and the amount of solvents for dissolving the developing agents must also be increased. Accordingly, the capacity of concentrates for preparing the developing solutions is increased. In addition, costs are increased. Hence, the application of this method is limited to a certain extent. In the method wherein the pH of the developing solutions is increased, stabilization of the developing solution is sacrificed. For the above-described reasons, there is a high need to accelerate the rate of development and increase the effective sensitivity of developed light-sensitive materials without raising development temperature, increasing costs and the capacity of concentrates for the developing solutions and without sacrificing the stabilization of the developing solutions. For this purpose, various development accelerators are commonly used.

Examples thereof include thioether compounds. The details thereof are described in L. F. A. Mason, *Photographic Processing Chemistry,* page 44 (1975 London, Focal Press), JP-A-58-221843 (the term "JP-A" as used herein means an "unexamined published Japanese patent application"), JP-A-51-90822, JP-A-51-89732, JP-A-49-90536 and JP-A-53-30331. The thioether compounds have an effective development accelerating function, but development is accelerated by dissolving silver halide, that is, by utilizing dissolving physical development. As a result, silver stain in the developing solutions is increased, the staining of the development rack and rollers of automatic processors is promoted, and the light-sensitive materials are marred and stained. The frequency of inspection for the maintenance of the automatic processors must be increased. Hence, the thioether compounds are not preferable from the viewpoint of practical use.

Typical methods for imparting high sensitivity and high contrast to silver halide light-sensitive materials include the methods wherein polyethylene glycols are used. The details thereof are described in U.S. Pat. Nos. 2,400,532, 2,848,830, 2,944,900, 3,385,708, 3,671,247 and 3,947,273.

The methods using polyethylene glycols are very effective in processing light-sensitive materials having silver halide emulsion layers containing commonly used silver halide grains such as spherical grains or cubic grains. However, the methods have the problem that graininess becomes poor, and hence these methods are of no practical use.

Further, the methods using polyethylene glycols are hardly effective in processing light-sensitive materials having silver halide emulsion layers comprising tabular grains which are considered to have a high covering power and to be advantageous in conducting rapid processing.

Accordingly, there is a demand for a method for effectively sensitizing silver halide photographic materials without reducing image quality.

SUMMARY OF THE INVENTION

An object of the present invention is to provide a method for the development of a silver halide light-sensitive material, which method enables rapid processing to be carried out and allows for the good stability of developing solutions to be maintained.

Nitrogen-containing heterocyclic mercapto compounds are known in the art as anti-fogging agents or stabilizers. Namely, these mercapto compounds are used to prevent fogging from occurring during the course of the manufacturing, storage or processing of light-sensitive materials or to stabilize photographic performance. The present inventors have eagerly studied rapid processing and found that among nitrogen-containing heterocyclic mercapto compounds, compounds represented by general formula (I) described hereinafter can contribute to give a stable image having a high maximum image density, a low minimum image density and excellent gradation, in a short period of time. This effect is specific to the compounds of general formula (I) and is an unexpected phenomenon.

Accordingly, the present invention relates to a method for the development of a silver halide light-sensitive material, wherein a silver halide light-sensitive material is developed in the presence of at least one compound represented by the following general formula (I):

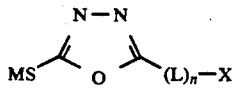

(I)

wherein M represents a hydrogen atom, an alkali metal atom, an ammonium group or a group which is cleaved under alkaline conditions; L represents a divalent organic group comprising an alkylene group, an alkenylene group, an ether group, a thioether group, —CO—, —CS— or —NR (wherein R is a hydrogen atom or an alkyl group) either alone or as a combination of two or more; X represents an amino group which may be substituted by an alkyl group, an ammonio group which may be substituted by an alkyl group, a hydroxyl group, or a heterocyclic group which may be substituted; and n represents 0 or 1.

DETAILED DESCRIPTION OF THE INVENTION

The compounds of general formula (I) are illustrated in more detail below.

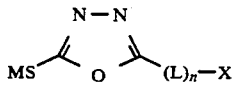

(I)

In general formula (I), M represents a hydrogen atom, an alkali metal atom (e.g., K, Na, Li), an ammonium group or a group which is cleaved under alkaline conditions (e.g., an acetyl group). L represents a divalent organic group comprising an alkylene group (having preferably 1 to 10 carbon atoms), an alkenylene group (having preferably 1 to 10 carbon atoms), an ether group, a thioether group, —CO—, —CS— or —NR— (wherein R is a hydrogen atom or an unsubstituted or substituted alkyl group (having preferably 1 to 10 carbon atoms)) either alone or as a combination of two or more.

Preferred examples of L include an alkylene group. The alkylene group may have one or more substituent groups (e.g., carboxyl group, sulfo group, an alkylthio group (having preferably 1 to 10 carbon atoms), the groups represented by X). X represents an amino group (including alkyl-substituted amino groups), an ammonio group (including alkyl group-substituted groups), a hydroxyl group or a heterocyclic group (including substituted heterocyclic groups). Preferred alkyl substituent groups include an alkyl group having 1 to 10 carbon atoms which may be substituted by a hydrophilic substituent group such as a hydroxyl group, a carboxyl group or a sulfo group. Preferred examples of the heterocyclic groups include five-membered and six-membered nitrogen atom-containing saturated or unsaturated heterocyclic rings such as

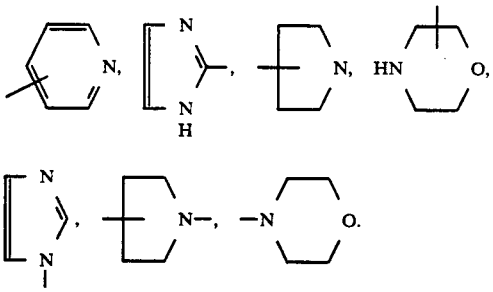

Examples of the substituent groups for the heterocyclic group include a hydroxyl group, a carboxyl group, a sulfo group, an alkyl group (having preferably 1 to 10 carbon atoms) and a halogen atom. A preferred example of X is an amino group which may be substituted by an alkyl group. In general formula (I), n represents 0 or 1.

Examples of the compounds represented by general formula (I) include, but are not limited to, the following compounds:

1.

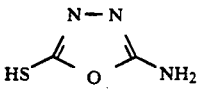

-continued

2.

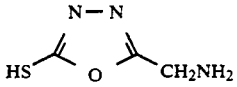

3.

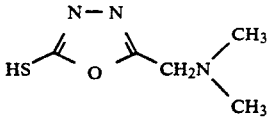

4.

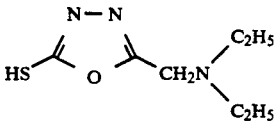

5.

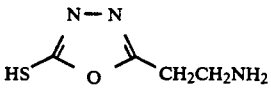

6.

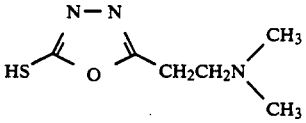

7.

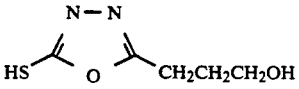

8.

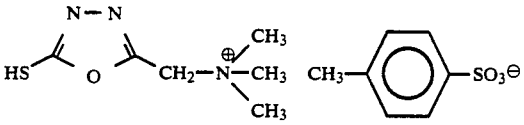

9.

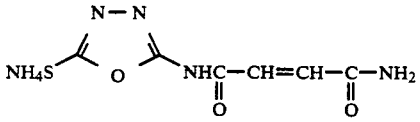

10.

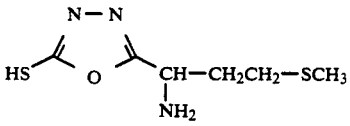

11.

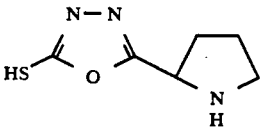

12.

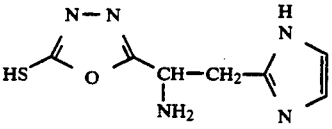

13.

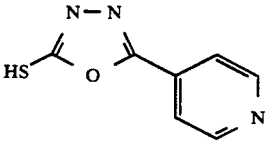

-continued

14.

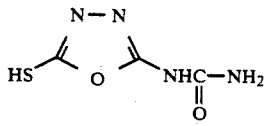

15.

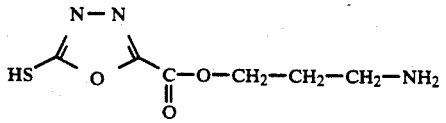

Synthesis of the compounds of general formula (I) is illustrated below by reference to the following synthesis examples.

Synthesis of Compound 3

Hydrazine hydrate (6.3 ml) was added to an ethanol (150 ml) solution of N,N-dimethylglycine methyl ester (15 g), and the mixture was stirred at room temperature for 12 hours. To the reaction mixture (solution) was added carbon disulfide (15 ml). Further, an ethanol (150 ml) solution of potassium hydroxide (8.5 g) was added thereto, and the mixture was heated with stirring for 6 hours. After the mixture was left to stand to cool it, concentrated hydrochloric acid (11 ml) was added thereto. The resulting crystal was collected by filtration and recrystallized from water (100 ml) to obtain Compound 3.

Yield: 12.3 g (60%)

Synthesis of Compound 7

Hydrazine hydrate (5.8 g was added to an ethanol (100 ml) solution of γ-butyrolacton (10 g), and the mixture was stirred at room temperature for 12 hours. To the reaction mixture was added carbon disulfide (11 ml). Further, an ethanol (150 ml) solution of potassium hydroxide (7.7 g) was added thereto, and the mixture was heated with stirring for 6 hours. After the mixture was left to stand to cool it, concentrated hydrochloric acid (10 ml) was added. The reaction mixture was concentrated under reduced pressure. Isopropyl alcohol (200 ml) was then added thereto and the inorganic salt was removed by filtration. Compound 7 was obtained as a crystal from the filtrate.

Yield: 4.6 g (25%)

Other compounds can be synthesized in the same manner as described above.

The compounds of general formula (I) can be added to the developing solutions (working solutions). The compounds are used in an amount of preferably 0.01 to 50 mmol/l, more preferably 0.05 to 10 mmol/l, and particularly preferably 0.1 to 5 mmol/l.

The compounds of general formula (I) in the form of an aqueous solution, an aqueous hydrochloric acid solution or a methanol solution can be added to a hydrophilic colloid solution for forming the photographic emulsion layers of a silver halide photographic material or other constituent layers (e.g., overcoat layers, filter layers, interlayers, etc., but preferably layers adjacent to the emulsion layers containing silver halide grains). The compounds may be added at any stage. However, it is preferred that when the compounds are added to the photographic emulsions, the addition is made during the period of just before coating and after chemical ripening. The compounds are used in an amount of preferably $1\times10^{-5}$ to $1\times10^{-1}$ mol, particularly preferably $1\times10^{-4}$ to $1\times10^{-3}$ mol, per mpl of silver.

Hydroquinones are the principal developing agent for use in the developing solutions of the present invention. However, a combination of a hydroquinone compound with a 3-pyrazolidone compound or a combination of a hydroquinone compound with a p-aminophenol compound is preferred from the viewpoint of easily obtaining good performance.

Examples of the hydroquinone developing agents include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone and hydroquinone monosulfonate. Among them, hydroquinone is particularly preferred.

Examples of the p-aminophenol developing agents which can be used in the present invention include N-methyl-p-aminophenol, p-aminophenol, N-(β-hydroxyethyl)-p-aminophenol, N-(4-hydroxyphenyl)glycine, 2-methyl-p-aminophenol and p-benzylaminophenol. Among them, N-methyl-p-aminophenol is particularly preferred.

Examples of the 3-pyrazolidone developing agents which can be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone.

The hydroquinone developing agents are used in an amount of generally 0.01 to 1.5 mol/l, preferably 0.05 to 1.2 mol/l.

In addition thereto, the p-aminophenol developing agents or 3-pyrazolidone developing agents are generally used in an amount of 0.0005 to 0.2 mol/l, preferably 0.001 to 0.1 mol/l.

Examples of sulfites which can be used in the developing solutions of the present invention include sodium sulfite, potassium sulfite, lithium sulfite, ammonium sulfite, sodium bisulfite and potassium metabisulfite. The sulfites are used in an amount of at least 0.1 mol/l, preferably at least 0.3 mol/l. It is preferable that the upper limit of the sulfite in the concentrate of the developing solution is not more than 2.5 mol/l.

The pH of the developing solutions used in the development of the present invention is in the range of preferably 9 to 13, more preferably 10 to 12.

Examples of the alkali agents used for setting the pH value include pH adjustors such as sodium hydroxide, potassium hydroxide, sodium carbonate, potassium carbonate, sodium tertiary phosphate and potassium tertiary phosphate.

Buffering agents such as the borates described in JP-A-62-186259, compounds (e.g., saccharose, acetoximes, 5-sulfosalicylic acid) described in JP-A-60-93433, phosphates and carbonates may be used.

It is preferred that the developing solutions of the present invention contain a chelating agent having a chelate stability constant of at least 8 against iron ion.

The term "chelate stability constant" as used herein refers to a constant which is conventionally known by L. G. Sillen and A. E. Martell, *Stability Constant of Metal-ion Complexes* (The Chemical Society, London 1964) and S. Chaberek and A. E. Martell, *Organic Sequestering Agents* (Wiley 1959).

Examples of the chelating agent having a chelate stability constant of at least 8 against iron ion include organic carboxylic acid chelating agents, organic phosphoric chelating agents, inorganic phosphoric chelating agents and polyhydroxy compounds. The term "iron ion" as described above refers to a ferric ion ($Fe^{3+}$)

Examples of the chelating agent having a chelate stability constant of at least 8 against ferric ion also include, but are not limited to, compounds such as ethylenediaminediorthohydroxyphenylacetic acid, triethylenetetraminehexaacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, 1,3-diamino-2-propanoltetraacetic acid, trans-cyclohexanediaminetetraacetic acid, ethylenediaminetetraacetic acid, glycol ether diaminetetraacetic acid, ethylenediamine-N,N,N',N'-tetrakismethylenephosphonic acid, nitrilo-N,N,N-trimethylenephosphonic acid, 1-hydroxyethylidene1,1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-disulfonic acid, sodium pyrophosphate, sodium tetrapolyphosphate and sodium hexametaphosphate.

The above-described developing solutions contain dialdehyde hardening agents and bisulfite adducts thereof. Examples thereof include glutaraldehyde and bisulfite adducts thereof.

Additives which may be used in addition to the above-described ingredients include restrainers such as sodium bromide, potassium bromide and potassium iodide; organic solvents such as ethylene glycol, diethylene glycol, triethylene glycol, dimethylformamide, methyl cellosolve, hexylene glycol, ethanol and methanol; and anti-fogging agents such as mercapto compounds (e.g, 1-phenyl-5-mercapto-tetrazole, sodium salt of 2-mercaptobenzimidazole-5-sulfonic acid), indazole , compounds (e.g., 5-nitroindazole) and benzotriazole compounds (e.g., 5-methylbenzotriazole). If desired, the developing solutions may contain the development accelerators described in *Research Disclosure,* Vol. 176, No. 17643, item XXI (December 1978), color toning agents, surfactants, anti-foaming agents, water softeners and amino compounds (as described in JP-A-56-106244).

In addition to the silver stain inhibitor of the present invention, other silver stain inhibitors such as the compounds described in JP-A-56-24347 may be incorporated in the developing solutions in the development of the present invention.

The developing solutions of the present invention may contain amino compounds such as the alkanolamines described in European Patent 136,582A, U.K. Patent 958,678, U.S. Patent 3,232,761 and JP-A-56-106244 to accelerate development or increase contact or for other purpose.

In addition, the compounds described in F. A. Mayson, *Photographic Processing Chemistry, pp.* 226–229 (Focal Press 1966), U.S. Pat. Nos. 2,193,015 and 2,592,364 and JP-A-48-64933 may be used.

The fixing solution is an aqueous solution containing a thiosulfate and has a pH of not lower than 3.8, preferably 4.2 to 7.0.

Examples of the fixing agents include sodium thiosulfate and ammonium thiosulfate. Ammonium thiosulfate is particularly preferred from the viewpoint of the rate of fixing. The amount of the fixing agent to be used can be properly changed, and the fixing agent is generally used in an amount of about 0.1 to about 6 mol/l.

The fixing solutions may contain water-soluble aluminum salts capable of functioning as hardening agents. Examples of the water-soluble aluminum salts include aluminum chloride, aluminum sulfate and potassium alum.

The fixing solutions may contain tartaric acid, citric acid, gluconic acid or derivatives thereof singly or in a combination of two or more. The fixing solutions containing these compounds in an amount of at least 0.005 mol per liter of the fixing solution are effective, and the fixing solutions containing these compounds in an amount of 0.01 to 0.03 mol/l are particularly effective.

If desired, the fixing solutions may contain preservatives (e.g., sulfites, bisulfites), pH buffering agents (e.g., acetic acid, boric acid), pH adjustors (e.g., sulfuric acid), chelating agents having a water softening ability and the compounds described in JP-A-62-78551.

In the present invention, the term "development stage time" or "development time" as used herein refers to the time taken until the top of the light-sensitive material to be processed is immersed in the subsequent fixing solution from the time that the top was immersed in the developing tank solution of an automatic processor. The term "fixing time" as used herein refers to the time until the top is immersed in the subsequent rinsing tank solution (stabilizing solution) from the time that the top was immersed in the fixing tank solution. The term "rinsing time" as used herein refers to the time during which the light-sensitive material is immersed in the rinsing tank solution.

The term "drying time" as used herein refers to the time during which the light-sensitive material is placed in a drying zone which is provided in the automatic processor. Hot air of 35° to 100° C., preferably 40° to 80° C., is generally blown into the drying zone.

In the development of the present invention, the development time is from 5 seconds to one minute, preferably from 5 to 30 seconds, and the development temperature is preferably from 25° to 50° C., more preferably from 25° to 40° C.

The fixing temperature and fixing time are preferably from about 20° to about 50° C. for 5 seconds to one minute, more preferably from 25° to 40° C. for 5 to 30 seconds.

Rinsing or stabilizing bath temperatures and times are preferably from 0° to 50° C. for 5 seconds to one minute, more preferably from 15° to 40° C. for 5 to 30 seconds.

According to the method of the present invention, the developed, fixed and rinsed (or stabilized) photographic materials are dried via squeezee rolls which squeeze rinsing water from the materials. Drying is conducted at a temperature of about 40° to about 100° C. Drying time properly varies depending on ambient conditions, but is generally from about 5 seconds to one minute, particularly preferably from about 5 to 30 seconds at a temperature of 40° to 80° C.

According to the method of development of the present invention, Dry to Dry time (the time taken until the top of a light-sensitive material leaves the drying zone of an automatic processor from the time that the top is introduced into the automatic processor) may be 30 to 60 seconds. Principal light-sensitive materials to which the present invention can be preferably applied include general-purpose black-and-white light-sensitive materials. In addition thereto, the present invention can be applied to reversal color light-sensitive materials, light-sensitive materials for laser printers which record medical images, printing scanner light-sensitive materials, direct X-ray light-sensitive materials for medical use, indirect X-ray light-sensitive materials for medical use, CRT light-sensitive materials, light-sensitive materials for X-ray cinema photographing, black-and-white negative films for photographing, black-and-white photographic materials for photographing and microfilms, without particular limitation.

The silver halide photographic material to which the method for development according to the present invention is applicable comprises a support and at least one silver halide emulsion layer coated thereon. The silver halide emulsion layer can be coated on not only one side, but on both sides of the support. If desired, the photographic material may be provided with back layers, antihalation layers, interlayers, and an uppermost layer (e.g., protective layer).

The silver halide emulsion is a dispersion of silver halide such as silver chloride, silver iodide, silver bromide, silver chlorobromide, silver iodobromide or silver chloroiodobromide, in a hydrophilic colloid. The silver halide emulsion is prepared by mixing a water-soluble silver salt (e.g., silver nitrate) with a water-soluble halide in the presence of water and a hydrophilic colloid in a conventional manner (e.g., single jet process, double jet process, controlled double jet process) and subjecting the resulting emulsion to physical ripening and chemical ripening such as gold sensitization and/or sulfur sensitization. The thus-prepared emulsion comprises cubic, octahedral or spherical silver halide grains, or tabular silver halide grains having a high aspect ratio as described in *Research Disclosure,* No. 22534 (January 1983).

A spectral sensitizing agent (e.g., cyanine dye, merocyanine dye or a mixture thereof), a stabilizer (e.g., 4-hydroxy-6-methyl-1,3,3a,7-tetrazaindene), a sensitizing agent (e.g., the compound described in U.S. Pat. No. 3,619,198), an anti-fogging agent (e.g., benzotriazole, 5-nitrobenzoimidazole), polyethylene oxide, a hardening agent and a coating aid (e.g., saponin, sodium laurylsulfate, dodecylphenol polyethylene oxide ether, hexadecyltrimethylammonium bromide) can be added to the silver halide emulsion during the course of the preparation thereof or just before coating.

The thus-prepared silver halide emulsion is coated on a support such as a cellulose acetate film or a polyethylene terephthalate film by means of a dip coating method, an air knife coating method, a bead method, an extrusion coating method, a doctor coating method or a double side coating method, and then dried.

The method for development according to the present invention is particularly suitable for use in processing surface latent image type silver halide photographic materials. The term "surface latent image type" as used herein refers to the materials wherein the sensitivity obtained by Surface Development (A) described below is higher than that obtained by Internal Development (B) described below when the light-sensitive material is developed by means of Surface Development (A) and Internal Development (B) after 1 to 100 second exposure. Sensitivity is defined by the following formula, $$Sensitivity = 100/Eh$$

wherein Eh represents the exposure amount required for obtaining just a middle density $[(D_{max}+D_{min})\times\frac{1}{2}]$ between maximum density ($D_{max}$) and minimum density ($D_{min}$).

Surface Development (A)

Development is carried out with a developing solution having the following formulation at 20° C. for 10 minutes:

| | |
|---|---|
| N-Methyl-p-aminophenol (hemisulfate) | 2.5 g |
| Ascorbic acid | 10.0 g |
| Sodium metaborate tetrahydrate | 35.0 g |
| Potassium bromide | 1.0 g |
| Water to make | 1 liter |

Internal Development (B)

Processing is carried out in a bleaching solution containing red prussiate (3 g/l) and phenosafranine (0.0125 g/l) at about 20° C. for 10 minutes. After rinsing for 10 minutes, development is carried out with a developing solution having the following formulation at 20° C. for 10 minutes:

| | |
|---|---|
| N-Methyl-p-aminophenol (hemisulfate) | 3.5 g |
| Ascorbic acid | 10.0 g |
| Sodium metaborate tetrahydrate | 35.0 g |
| Potassium bromide | 1.0 g |
| Sodium thiosulfate | 3.0 g |
| Water to make | 1 liter |

It is particularly preferred that tabular silver halide grains are used in X-ray processing.

When tabular grains are used, the grains have an aspect ratio of preferably not lower than 4, but lower than 20, more preferably not lower than 5, but lower than 10. Further, the grains have a thickness of preferably not more than 0.3μ, particularly preferably not more than 0.2μ.

The aspect ratio of the tabular grains is the ratio of the mean value of the diameters of circles (each circle having an area equal to the projected area of each grain) to the mean value of the thicknesses of the grains.

It is preferred that tabular grains account for at least 80% by weight, more preferably at least 90% by weight of the entire silver halide grains.

A spectral sensitizing agent (e.g., cyanine dye, merocyanine dye or a mixture thereof), a stabilizer (e.g., 4-hydroxy-6-methyl-1,3,3a,7-tetrazaindene), a sensitizing agent (e.g., the compounds described in U.S. Pat. No. 3,619,198), an anti-fogging agent e.g., benzotriazole, 5-nitrobenzoimidazole), polyethylene oxide, a hardening agent and a coating aid (e.g., saponin, sodium laurylsulfate, dodecylphenol polyethylene oxide ether, hexadecyltrimethylammonium bromide) can be added to the tabular silver halide emulsion during the course of the preparation thereof or just before coating.

The thus-prepared tabular silver halide emulsion is coated on a support such as cellulose acetate film or polyethylene terephthalate film by means by a dip coating method, an air knife coating method, a bead method, an extrusion method, a doctor coating method or a double side coating method, and then dried.

The present invention is now illustrated in greater detail by reference to the following examples which, however, are not to be construed as limiting the invention in any way.

EXAMPLE 1

(1) Preparation of Emulsion

To one liter of water were added 5 g of potassium bromide, 0.05 g of potassium iodide, 30 g of gelatin and 2.5 cc of a 5% aqueous solution of thioether $HO(CH_2)_2S(CH_2)_2S(CH_2)_2OH$. To the resulting solution kept at 73° C. were added an aqueous solution of 8.33 g of silver nitrate and an aqueous solution containing 5.94 g of potassium bromide and 0.726 g of potassium iodide with stirring over a period of 45 seconds by means of a double jet process. Subsequently, 2.5 g of potassium bromide was added thereto, and an aqueous solution containing 8.33 g of silver nitrate was then added thereto over a period of 26 minutes at such a rate that the flow rate at the time of completion of the addition was twice that at the time of the commencement of the addition.

Thereafter, 20 cc of a 25% ammonia solution and 10 cc of 50% $NH_4NO_3$ were added thereto, and physical ripening was carried out for 20 minutes. The mixture was then neutralized with 240 cc of 1N sulfuric acid. Subsequently, an aqueous solution of 153.3 g of silver nitrate and an aqueous solution of potassium bromide were added thereto over a period of 40 minutes by means of a controlled double jet process while keeping the potential at a pAg of 8.2. The flow rate of the addition was accelerated so that the flow rate at the time of completion of the addition was 9 times that at the time of the commencement of the addition. After completion of the addition, 15 cc of a 2N potassium thiocyanate solution was added thereto, and further 25 cc of a 1% aqueous solution of potassium iodide was added thereto over a period of 30 seconds.

The temperature of the emulsion was lowered to 35° C., and soluble salts were removed by a flocculation method. The temperature was then elevated to 40° C., and 30 g of gelatin and 2 g of phenol were added thereto. The pH and pAg were adjusted to 6.40 and 8.10, respectively by sodium hydroxide and potassium bromide.

After the temperature was elevated to 56° C., 600 mg of the sensitizing dye having the following structure and 150 mg of the stabilizer having the following structure were added thereto. After 10 minutes, 2.4 mg of sodium thiosulfate pentahydrate, 140 mg of potassium thiocyanate and 2.1 mg of chloroauric acid were added to each emulsion. After 80 minutes, the mixture was quenched for solidification to form an emulsion. The resulting emulsion comprised grains having such a grain size distribution that grains having an aspect ratio of not lower than 3 accounted for 98% of the sum total of the projected areas of the entire grains. With regard to all grains having an aspect ratio of not lower than 2, the average diameter of the projected areas was 1.4 μm, the standard deviation was 22%, the average thickness was 0.187 μm, and the aspect ratio was 7.5.

Sensitizing Dye

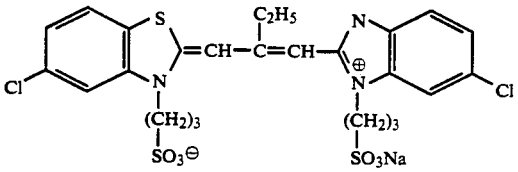

Stabilizer

-continued

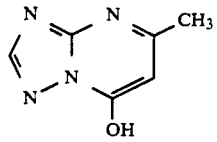

Preparation of Emulsion Coating Solution

The following reagents per mol of silver halide were added to the emulsion to prepare a coating solution

| | |
|---|---|
| Gelatin added in such an amount as to give a ratio of silver/binder (gelatin + polymer) of 0.7. | |
| Water-soluble polyester (wt % based on the amount of gelatin) | 20% |
| Polymer latex (poly(ethyl acrylate/methacrylate acid) = 97/3) | 25.0 g |
| Hardening agent 1,2-Bis(sulfonylacetamido)ethane 8 mmol/100 g of gelatin of emulsion layer of surface protective layer | |
| Phenoxyethanol | 2 g |
| 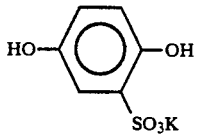 | 12 g/Ag · mol |
| 2,6-Bis(hydroxyamino)-4-diethylamino-1,3,5-triazine | 80 mg |
| Polysodium acrylate (average MW = 41,000) | 4.0 g |
| Polypotassium styrenesulfonate (average MW = 600,000) | 1.0 g |

The above coating solution and a coating solution for a surface protective layer were simultaneously coated on a transparent PET support of 175 μm in thickness.

The total amount of coated silver on both sides was 3.2 g/m².

A coating solution for a surface protective layer was prepared by using the following components in the following amounts:

| Composition of surface protective layer | Coating weight (g/m²) |
|---|---|
| Gelatin | 1.15 |
| Polyacrylamide (average MW = 45,000) | 0.25 |
| Polysodium acrylate (average MW = 400,000) | 0.02 |
| Sodium salt of p-t-octylphenoxy-diglycerylbutylsufonated material | 0.02 |
| Poly(degree of polymerization: 10)-oxyethylene cetyl ether | 0.035 |
| Poly(degree of polymerization: 10)-oxyethylene-poly(degree of polymerization: 3)oxyglyceryl-p-octylphenoxy ether | 0.01 |
| $C_8F_{17}SO_3K$ | 0.003 |
| $C_8F_{17}SO_2N(C_3H_7)(CH_2)_4(CH_2)_4SO_3Na$ | 0.001 |
| $C_8F_{17}SO_2N(C_3H_7)(CH_2CH_2O)_{10}(CH_2CHCH_2O)_4H$ | 0.003 |
| Proxel | 0.001 |

-continued

| Composition of surface protective layer | Coating weight ($g/m^2$) |
|---|---|
| Polymethyl methacrylate (average particle size: 3.5 μm) | 0.025 |
| Poly(methyl methacrylate/methacrylic acid) (molar ratio = 7:3, average particle size: 2.5 μm) | 0.020 |

(2) Preparation of Developing Solution

The formulations of concentrated liquid developers Part A, Part B, Part C and starter are as follows:

| | |
|---|---|
| Part A for 10 l | |
| Diethylenetriaminepentaacetic acid | 20 g |
| Potassium hydroxide | 291 g |
| Potassium sulfite | 442 g |
| Sodium hydrogencarbonate | 75 g |
| Boric acid | 10 g |
| Hydroquinone | 300 g |
| Diethylene glycol | 120 g |
| 5-Methylbenzotriazole | 0.2 g |
| Potassium bromide | 15 g |
| Water to make | 2.5 l |
| Part B for 10 l | |
| Triethylene glycol | 200 g |
| Glacial acetic acid | 40 g |
| 5-Nitroindazole | 2.5 g |
| 1-Phenyl-3-pyrazolidone | 15 g |
| Water to make | 250 ml |
| Part C for 10 l | |
| Glutaraldehyde (50 wt %) | 100 g |
| Sodium metabisulfite | 126 g |
| Water to make | 250 ml |
| Starter | |
| Glacial acetic acid | 150 g |
| Potassium bromide | 300 g |
| Water to make | 1.5 l |

The working solution was prepared so that 2.5 l of Part A, 400 ml of Part B and 250 ml of Part C. in order were dissolved in about 6 l of water with stirring. Finally, water was added thereto to make the solution 10 l, and the pH thereof was adjusted to 10.40. The resulting working solution was referred to as a developing replenisher. Twenty ml of the starter was added to 1 l of the replenisher. The resulting solution was the developing solution.

The following developing solutions were prepared by using the developing solution prepared above. Subsequently, the pH of the developing solutions was adjusted to 10.25.

| Developing Solution Sample No. | Compound added to the developing solution prepared above |
|---|---|
| 1 (Comp. Ex.) | not added |
| 2 (Comp. Ex.) | Compound described in JP-B-48-8131 (the term "JP-B" as used* herein means an "examined Japanese patent publication") 0.2 g of 2-mercapto-5-aminophenyl-1,3,4-oxadiazole was added to 1 l of the developing solution. |
| 3 (Comp. Ex.) | 0.13 g of 2-mercapto-5-ethyl-1,3,4-oxadiazole was added to* 1 l of the developing solution. |
| 4 (Invention) | Compound 3 (0.16 g) of the invention was added to 1 l* of the developing solution. |
| 5 (Invention) | Compound 4 (0.28 g) of the invention was added to 1 l* of the developing solution. |
| 6 (Invention) | Compound 8 (0.35 g) of the invention was added to 1 l* of the developing solution. |
| 7 (Invention) | Compound 13 (0.18 g) of the invention was added to 1 l* of the developing solution. |

-continued

*Amount added was equimolar amount.

Fuji F (a product of Fuji Photo Film Co., Ltd.) was used for fixing.

The above-described light-sensitive material and processing solutions were used to carry out the following development in a roller conveying type automatic processor (FPM-9000 manufactured by Fuji Photo Film Co., Ltd.):

| Processing stage | Temp. (°C.) | Time (sec) | Replenishment rate |
|---|---|---|---|
| 90 Second Processing | | | |
| Development | 35 | 25 | 45 ml/10 × 12 in. |
| Fixing | 30 | 20 | 60 ml/10 × 12 in. |
| Rinsing | 20 | 11 | 3 l/1 min. |
| Squeeze drying | 50 | 34 | / |
| Total | | 90 | / |
| 45 Second Processing | | | |
| Development | 35 | 14 | 45 ml/10 × 12 in. |
| Fixing | 32 | 12 | 60 ml/10 × 12 in. |
| Rinsing | | 8 | 3 l/1 min. |
| Squeeze drying | | 11 | / |
| Total | | 45 | / |

Photographic characteristics are shown in the following table. Among the photographic characteristics, fog value was measured as an increase in the net density obtained by correcting the density of the base. Gradation $\overline{G}$ represents a gradient of a straight line formed by joining a point of a density of (Fog+0.25) to a point of a density of (Fog+2.0). Sensitivity is determined by the relative value of the reciprocal of the exposure amount giving a blackening density of (Fog+0.1). Dm represents maximum density.

| Test No. | Developing Solution Sample No. | Processing Time (sec) | Fog | $\overline{G}$ | Sensitivity | Dm |
|---|---|---|---|---|---|---|
| 1 (Comp. Ex.) | 1 | 90 | 0.04 | 2.90 | 100 | 3.50 |
| 2 (Comp. Ex.) | " | 45 | 0.03 | 2.50 | 60 | 3.10 |
| 3 (Comp. Ex.) | 2 | " | " | 2.45 | 57 | 3.15 |
| 4 (Comp. Ex.) | 3 | " | " | 2.60 | 55 | 3.05 |
| 5 (Invention) | 4 | " | 0.04 | 2.95 | 105 | 3.60 |
| 6 (Invention) | 5 | " | " | 2.92 | 102 | 3.55 |
| 7 (Invention) | 6 | " | " | 2.91 | 101 | 3.52 |
| 8 (Invention) | 7 | " | " | 2.93 | 103 | 3.53 |

It can be found from the results of photographic characteristics that in Test No. 2 wherein a 45 second processing was carried out with a developing solution which does not contain the compound of the invention, G, sensitivity and Dm are greatly lowered in comparison with the 90 second processing. In Test Nos. 3 and 4 wherein a 45 second processing was carried out with the developing solution containing a compound which is similar to that of the invention, but outside the scope of the compound of the invention, the results are substantially the same as those of Test No. 2 and an effect of accelerating development can not be obtained. In Test Nos. 5 to 8 wherein a 45 second processing is carried out with the developing solution containing the compound of the invention, the remarkable effect of accelerating development can be obtained in comparison with Test No. 2, and similar results to those of Test No. 1 can be obtained.

When the 45 second processing was repeatedly carried out with the compounds of the invention, silver stain was scarcely formed and constant photographic performance could be obtained.

EXAMPLE 2

(1) Preparation of Fine AgI Grains

To 2 l of water were added 0.5 g of potassium iodide and 26 g of gelatin. To the resulting solution kept at 35° C. were added 80 cc of an aqueous silver nitrate solution containing 40 g of silver nitrate and 80 cc of an aqueous solution containing 39 g of potassium iodide with stirring over a period of 5 minutes. The addition of the aqueous silver nitrate solution and the aqueous potassium iodide solution was made at such a rate that the flow rate of each solution at the time of the commencement of the addition was 8 cc/min, and the flow rate of the addition was linearly accelerated so as to allow the addition of 80 cc of each solution to be completed in 5 minutes.

After the formation of grains was completed, soluble salts were removed at 35° C. by a flocculation method.

Subsequently, the temperature of the emulsion was elevated to 40° C., 10.5 g of gelatin and 2.56 g of phenoxyethanol were added thereto, and the pH thereof was adjusted to 6.8 by adding sodium hydroxide. The resulting emulsion weighed 730 g (finished amount) and comprised monodisperse fine AgI grains having a mean diameter of 0.015 μm.

(2) Preparation of Tabular Grain Emulsion

To 1 l of water were added 4.5 g of potassium bromide, 20.6 g of gelatin and 2.5 cc of a 5% aqueous solution of thioether $HO(CH_2)_2S(CH_2)_2S(CH_2)_2OH$. To the resulting solution kept at 60° C. were added 37 cc of an aqueous silver nitrate solution (silver nitrate content: 3.43 g) and 33 cc of an aqueous solution containing 2.97 g of potassium bromide and 0.363 g of potassium iodide with stirring over a period of 37 seconds by means of a double jet process. Subsequently, an aqueous solution of 0.9 g of potassium bromide was added thereto. After the temperature of the mixture was elevated to 70° C., 53 cc of an aqueous silver nitrate solution (silver nitrate content: 4.90 g) was added thereto over a period of 13 minutes, and 15 cc of 25% ammonia water was added thereto. The mixture at that temperature was physically ripened for 20 minutes, and 14 cc of a 100% acetic acid solution was added thereto.

Subsequently, an aqueous solution of 133.3 g of silver nitrate and an aqueous solution of potassium bromide were added thereto over a period of 35 minutes by means of a controlled double jet process while keeping pAg at 8.5. Thereafter, 10 cc of a 2N potassium thiocyanate solution and 0.05 mol % (based on the total amount of silver) of the above-described fine AgI grains were added thereto. The emulsion was physically ripened at that temperature for 5 minutes, and the temperature was lowered to 35° C.

There were obtained monodisperse tabular fine grains having a total iodide content of 0.31 mol %, an average diameter (based on projected areas) of 1.10 μm, a thickness of 0.165 μm and a coefficient of variation in diameter of 18.5%.

Thereafter, soluble salts were removed by a flocculation method. The temperature of the emulsion was elevated to 40° C., and 35 g of gelatin, 2.35 g of phenoxyethanol and 0.8 g of polysodium styrenesulfonate as a thickener were added thereto. The pH and pAg were adjusted to 5.90 and 8.25, respectively by sodium hydroxide and a silver nitrate solution.

The emulsion was chemically sensitized while keeping the temperature at 56° C. with stirring.

Namely, reduction sensitization was first carried out by adding 0.043 mg of thiourea dioxide and retaining the emulsion as such for 22 minutes. Subsequently, 20 mg of 4-hydroxy-6-methyl-1,3,3a,7-tetrazaindene and 500 mg of the following Sensitizing Dye A were added thereto. Further, 1.1 g of an aqueous solution of calcium chloride was added. Subsequently, 3.3 mg of sodium thiosulfate, 2.6 mg of chloroauric acid and 90 mg of potassium thiocyanate were added thereto. After 40 minutes, the emulsion was cooled to 35° C.

Sensitizing Dye A

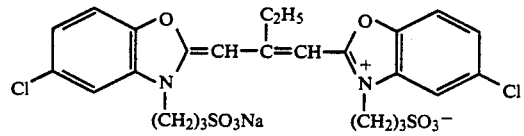

In this way the preparation of the tabular grain emulsion of the present invention was completed.

Preparation of Coated Sample

The following reagents were added to the emulsion to prepare a coating solution, the amount of each reagent being per mol of silver halide:

| | |
|---|---|
| 2,6-Bis(hydroxyamino)-4-diethylamino-1,3,5-triazine | 72 mg |
| Gelatin | 30 g |
| Trimethylolpropane | 9 g |
| Dextran (average MW = 39,000) | 18.5 g |
| Polysodium styrenesulfonate (average MW = 600,000) | 1.8 g |
| Hardening agent 1,2-Bis(vinylsulfonylacetamido)ethane | 34 mg |

The amount of the hardening agent to be added was adjusted so as to give a swelling ratio of 225%.

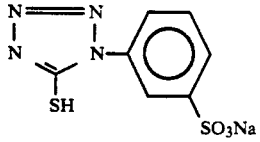

-continued

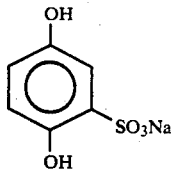

10.9 g

Preparation of Coating Solution for Surface Protective Layer

A coating solution for a surface protective layer was prepared by using the following ingredients in such an amount as to give the following coating weight:

| Composition of surface protective layer | Coating weight ($g/m^2$) |
|---|---|
| Gelatin | 0.966 |
| Polysodium acrylate (average MW = 400,000) | 0.023 |
| 4-Hydroxy-6-methyl-1,3,3a,7-tetrazaindene | 0.015 |
| 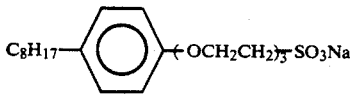 | 0.013 |
| $C_{16}H_{33}O(CH_2CH_2O)_{10}H$ | 0.045 |
| $C_{17}H_{33}CON(CH_3)CH_2CH_2SO_3Na$ | 0.0065 |
| $C_8F_{17}SO_2N(C_3H_7)(CH_2CH_2O)_{15}H$ | 0.003 |
| $C_8F_{17}SO_2N(C_3H_7)(CH_2CH_2O)_4(CH_2)_4SO_3Na$ | 0.001 $g/m^2$ |
| Polymethyl methacrylate (average particle size: 3.7 μm) | 0.087 |
| Proxel (pH was adjusted with NaOH to 6.4) | 0.0005 |

Preparation of Support (1) Preparation of Dye D-1 for Undercoat Layer

The following dye was treated in a ball mill according to the method described in JP-A-63-197943:

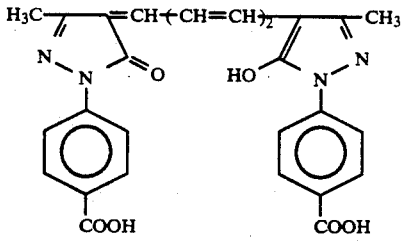

434 ml of water and 791 ml of a 6.7% aqueous solution of surfactant Tritron® X-200 (TX-200) were placed in a 2 l ball mill. To the solution was added 20 g of the dye. 400 ml of beads (2 mm in diameter) of zirconium oxide (ZrO) were added thereto, and the contents were crushed for 4 days. Subsequently, 160 g of 12.5% gelatin was added thereto. After defoaming, ZrO beads were removed by filtration. The resulting dye dispersion was inspected and it was found that the crushed dye had a wide particle size distribution ranging from a diameter of 0.05 μm to a diameter of 1.15 μm and the average particle size was 0.37 μm.

Further, the dispersion was centrifuged to remove dye particles having a particle size of not smaller than 0.9 μm.

In this way, the dye dispersion D-1 was obtained.

(2) Preparation of Support

A biaxially oriented polyethylene terephthalate film of 183 μm in thickness was subjected to a corona discharge treatment.

A first undercoating solution having the following composition was then coated on the film in such an amount as to give a coating weight of 5.1 $cc/m^2$. The coating was carried out by means of a wire bar coater. The coated film was dried at 175° C. for one minute. A first undercoat layer was also provided on the other side in the same manner as described above. The polyethylene terephthalate used contained 0.04 wt % of the dye having the following structure:

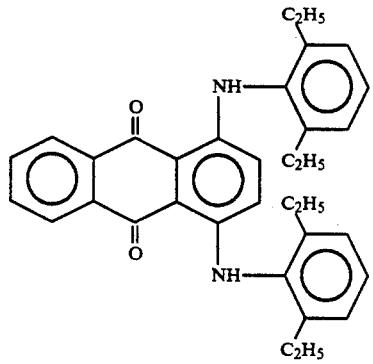

Formulation of first undercoating solution

| | |
|---|---|
| Butadine-styrene copolymer latex solution (solids content: 40%, butadiene/styrene ratio = 31/69 by weight) | 79 cc |
| 4% solution of sodium salt of 2,4-dichloro-6-hydroxy-s-triazine | 20.5 cc |
| Distilled water | 900.5 cc |

The above latex solution contained 0.4 wt % (based on the solids content in latex) of the compound

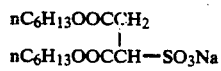

as an emulsifying dispersant.

A second undercoating solution having the following composition was coated on the first undercoat layer on both sides in such an amount as to give the following coating weight. The coating was conducted one side by one side. Both sides were coated by means of a wire bar coater and dried at 150° C.

Formulation of second undercoating solution

| | |
|---|---|
| Gelatin | 160 $mg/m^2$ |
| Dye dispersion D-1 (on a solids basis) | 26 $mg/m^2$ |

-continued

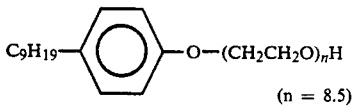

8 mg/m²

(n = 8.5)

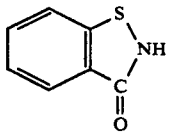

0.27 mg/m²

Matting agent 25 mg/m² polymethyl methacrylate particles having an average particle size of 2.5 μm

Preparation of Photographic Material

The emulsion layer and the surface protective layer were coated on both sides of the above-described transparent support by means of co-extrusion method. The amount of silver coated was 1.7 g/m² per one side.

In this way, a light-sensitive material was obtained.

The light-sensitive material was left to stand at 25° C. and 60% RH for 7 days. At this point, the swelling ratio of the hydrophilic colloid layer was measured. The dry thickness (a) was determined by inspecting a cut piece through a scanning type electron microscope. The thickness (b) of the swollen layer was determined by inspecting the light-sensitive material through a scanning type electron microscope after the light-sensitive material as immersed in distilled water at 21° C. for 3 minutes was freeze-dried by liquid nitrogen. The swelling ratio was determined by the following formula:

$$\text{Swelling ratio} = \frac{(b) - (a)}{(a)} \times 100(\%)$$

The swelling ratio of the light-sensitive material was 225%.

A concentrated liquid developer having the following formulation and a concentrated liquid fixer having the following formulation were used in this Example:

| Concentrated liquid developer (2.5-fold concentration) | |
|---|---|
| Potassium hydroxide | 43 g |
| Sodium sulfite | 100 g |
| Potassium sulfite | 126 g |
| Diethylenetriaminepentaacetic acid | 5 g |
| Boric acid | 20 g |
| Hydroquinone | 85 g |
| 4-Hydroxymethyl-4-methyl-1-phenyl-3-pyrazolidone | 4 g |
| Diethylene glycol | 30 g |
| 5-Methylbenzotriazole | 0.2 g |
| Potassium bromide | 10 g |
| Water to make | 1 liter |
| (pH was adjusted to 10.65) | |

The above concentrated liquid developer was diluted in the following manner to prepare a working solution.

| Concentrated liquid developer (400 ml) + water (600 ml) = working solution (pH was adjusted to 10.35) | |
|---|---|
| Concentrated liquid fixer (4-fold concentration) | |
| Ammonium thiosulfate | 500 g |
| Disodium ethylenediaminetetraacetate dihydrate | 0.1 g |
| Sodium thiosulfate pentahydrate | 50 g |
| Sodium sulfite | 60 g |
| Potassium hydroxide | 25 g |
| Acetic acid | 100 g |
| Water to make | 1 liter |
| (pH was adjusted to 5.1) | |
| The above concentrated liquid fixer was diluted in the following manner to prepare a working solution. | |
| Concentrated liquid fixer (250 ml) + water (750 ml) = working solution (pH was adjusted to 5.0) | |

Three samples of the above described developing solution (working solution), a sample (obtained by adding Compound 3 (0.16 g/l) of the present invention to the developing solution) and a sample (obtained by adding Compound 8 (0.35 g/l) of the present invention to the developing solution) were prepared. These three developing solution samples were used, and the above light-sensitive material was developed in a roller conveying type automatic processor in the following manner:

| (Path length = 1950 mm) | | | |
|---|---|---|---|
| Processing stage | Temp. (°C.) | Time (sec) | Replenishment rate |
| Development | 35 | 9 | 25 ml/10 × 12 in |
| Fixing | 32 | 7 | 25 ml/10 × 12 in |
| Rinsing | 20 | 5 | 3 l/1 min |
| Squeeze drying | 55 | 9 | |
| Total | | 30 | |

The photographic characteristics are shown in the following Table.

| Test No. | Processing | Processing Time (sec) | Fog | $\bar{G}$ | Sensitivity | Dm |
|---|---|---|---|---|---|---|
| 1 (Comp. Ex.) | Test No. 1 of Ex. 1 | 90 | 0.04 | 2.90 | 100 | 3.50 |
| 2 (Comp. Ex.) | not added | 30 | 0.03 | 2.40 | 65 | 3.15 |
| 3 (Invention) | Compound 3 was added | " | 0.04 | 2.93 | 102 | 3.52 |
| 4 (Invention) | Compound 8 was added | " | 0.04 | 2.92 | 101 | 3.49 |

In Test Nos. 3 and 4 wherein 30 second processing was carried out with the developing solution containing the compound of the present invention, the developing solutions have the remarkable effect of accelerating development and similar results to those of Test No. 1 can be obtained.

EXAMPLE 3

The same experiment (30 seconds) as that of Example 2 was made except that SRX-1001 (a product of Konica Corporation) was used as the automatic processor and linear velocity was increased so that Dry to Dry was 30 seconds. There were obtained similar results to those of Example 2.

EXAMPLE 4

(1) Preparation of Silver Halide Emulsion

An appropriate amount of ammonia was added to a reaction vessel which contained gelatin, potassium bromide and water and was heated to 55° C. While keeping the pAg value in the reaction vessel at 7.60, an aqueous silver nitrate solution and an aqueous potassium bromide solution containing a hexachloroiridate(III) (in a molar ratio of iridium to silver of $10^{-7}$) were added to the vessel by means of a double jet process. In this way, two kinds of monodisperse silver bromide emulsion grains having a mean grain size of 0.7μ and 0.40μ were prepared by changing the amount of ammonia. These emulsion grains had such a grain size distribution that 98% of the entire grains had a grain size within ±40% of the mean grain size. In the latter stage of the formation of the grains, $1\times10^{-3}$ mol of potassium iodide per mol of silver was added. After these emulsions were desalted, the pH thereof was adjusted to 6.2 and the pAg was adjusted to 8.6. Subsequently, gold-sulfur sensitization was carried out by using sodium thiosulfate and chloroauric acid to obtain the desired photographic characteristics. The ratio of the (100) face/the (111) face of these emulsions was 93/7 as measured by the Kubelka-Munk method.

(2) Preparation of Emulsion Coating Solution

In a container, there was weighed 0.5 kg of each of the above two kinds of the emulsions. The container was heated to 40° C. to dissolve the emulsion. To the container were then added 30 cc of a methanol solution of the following infrared sensitizing dye ($9\times10^{-4}$ mol/l), 130 cc of an aqueous solution of the following super-sensitizing agent ($4.4\times10^{-3}$ mol/l), 35 cc of a methanol solution of the following light-sensitive material preservability improver ($2.8\times10^{-2}$ mol/l), an aqueous solution of 4-hydroxy-6-methyl-1,3,3a,7-tetrazaindene, an aqueous solution of a dodecylbenzenesulfonate as a coating aid and an aqueous solution of polypotassium p-vinylbenzenesulfonate as a thickener to prepare an emulsion coating solution.

Infrared Sensitizing Dye:

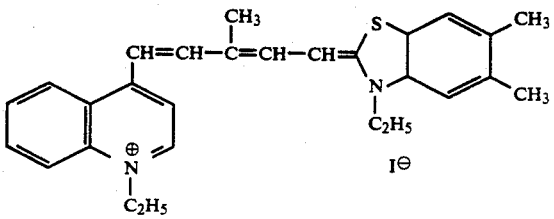

-continued

Supersensitizing Agent:
Disodium salt of 4,4'-bis[2,6-di(2-naphthoxy)-pyrimidine-4-ylamino]stilbene-2,2'-disulfonic acid Light-sensitive Material Preservability Improver:

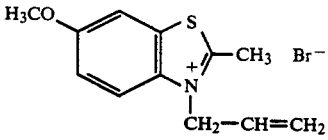

(3) Preparation of Coating Solution for Surface Protective Layer of Light-Sensitive Material To a 10 wt % aqueous gelatin solution heated to 40° C. were added an aqueous solution of polysodium styrenesulfonate as a thickener, fine particles of polymethyl methacrylate (average particle size: 3.0 μm) as a matting agent, N,N'-ethylenebis(vinylsulfonylacetamido) as a hardening agent, an aqueous solution of sodium t-octylphenoxyethoxyethanesulfonate as a coating aid, an aqueous solution of a polyethylene surfactant as an antistatic agent and an aqueous solution of the fluorine-containing compounds having the following structures as an antistatic agent to prepare a coating solution.

$C_8F_{17}SO_2N(C_3H_7)CH_2COOK$ and
$C_8F_{17}N(C_3H_7)(CH_2CH_2—O—)_{15}H$

(4) Preparation of Coating Solution for the Back Layer

To one kg of a 10 wt % aqueous gelatin solution heated to 40° C. were added an aqueous solution of polysodium styrenesulfonate as a thickener, 50 cc of an aqueous solution of the following back dye ($5\times10^{-2}$ mol/l), an aqueous solution of N,N'-ethylenebis(vinylsulfonylacetamido) as a hardening agent and an aqueous solution of sodium t-octylphenoxyethoxyethanesulfonate as a coating aid to prepare a coating solution.

Back Dye:

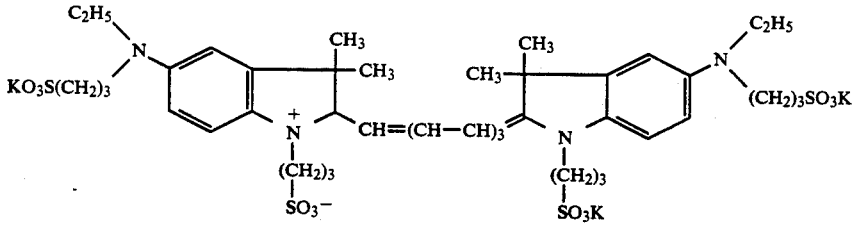

(5) Preparation of the Coating Solution for Surface Protective Layer of Back Layer To a 10 wt % aqueous gelatin solution heated to 40° C. were added an aqueous solution of polysodium styrenesulfonate as a thickener, fine particles of polymethyl methacrylate (average particle size: 3.0 μm) as a matting agent, an aqueous solution of sodium t-octylphenoxyethoxyethane sulfonate as a coating aid, an aqueous solution of a polyethylene surfactant as an antistatic agent and an aqueous solution of the following fluorine-containing compounds as an antistatic agent to prepare a coating solution.

$C_8F_{17}SO_2N(C_3H_7)CH_2COOK$ and
$C_8F_{17}SO_2N(C_3H_7)(CH_2CH_2—O—)_{15}H$ (6) Preparation of Coated Sample The coating solution for the back layer and the coating solution for the surface protective layer of the back layer were coated on one side of a polyethylene terephthalate support in such an amount as to give a coating weight of 4 g/m$^2$ of gelatin. Subsequently, the emulsion coating solution containing the infrared sensitizing dye prepared in the above preparation step (2) and the coating solution for the surface protective layer of the light-sensitive layer were coated on the other side of the support in such an amount as to give a coating weight of 3.2 g/m$^2$ in terms of silver while controlling the amount of the hardening agent in the coating solution for the surface protective layer so that the swelling ratio of the coated layer became 110%.

(7) Method for Measuring Swelling Ratio (a) The coated sample is incubated at 38° C. and 50% RH. (b) The thickness of the layer is measured. (c) The sample is immersed in distilled water at 21° C. for 3 minutes. (d) The thickness of the layer obtained in the stage (c) is compared with the thickness of the layer measured in the stage (b), and the ratio (%) of a change in the thickness of the layer is measured.

Processing

The same developing solutions and fixing solution as those used in Example 2 were used.

The developing solution (working solution of Example 2), a sample obtained by adding Compound 3 (0.16 g/l) of the present invention to the developing solution and a sample obtained by adding Compound 13 (0.18 g/l) of the present invention to that developing solution were used. The above described light-sensitive material was developed in the following manner by using these developing solutions and a roller conveying type automatic processor.

| Processing stage | Temp. (°C.) | Time (sec) | Replenishment rate |
|---|---|---|---|
| | 60 Second Processing | | |
| Development | 35 | 11.5 | 50 ml/25.7 × 36.4 cm |
| Fixing | 30 | 12.5 | " |
| Rinsing | 20 | 10 | 3 l/1 min. |
| Squeeze drying | 50 | 26 | |
| Total | | 60 | |
| | 30 Second Processing | | |
| Development | 35 | 6 | 50 ml/25.7 × 36.4 cm |
| Fixing | 35 | 6 | " |
| Rinsing | 20 | 5 | 3 l/1 min. |
| Squeeze drying | 50 | 13 | |
| Total | | 30 | |

The results of photographic characteristics are shown in the following table.

| Test No. | Developing Solution | Processing Time (sec) | Fog | $\bar{G}$ | Sensitivity | Dm |
|---|---|---|---|---|---|---|
| 1 (Comp. Ex.) | not added | 60 | 0.04 | 2.70 | 100 | 3.20 |
| 2 (Comp. Ex.) | " | 30 | 0.03 | 2.20 | 55 | 2.80 |
| 3 (Invention) | Compound 3 of the invention was added | " | 0.04 | 2.75 | 102 | 3.25 |
| 4 (Invention) | Compound 13 of the invention was added | " | 0.04 | 2.72 | 101 | 3.22 |

Similar photographic results to those of Test No. 1 were obtained even in 30 second processing when the compounds of the present invention are used.

EXAMPLE 5

(1) Preparation of Tabular Grains

Preparation of Emulsion

To one liter of water were added 5 g of potassium bromide, 0.05 g of potassium iodide, 30 g of gelatin and 2.5 cc of a 5% aqueous solution of thioether $HO(CH_2)_2S(CH_2)_2S(CH_2)_2OH$. To the resulting solution kept at 73° C. were added an aqueous solution of 8.33 g of silver nitrate and an aqueous solution containing 5.94 g of potassium bromide and 0.726 g of potassium iodide with stirring over a period of 45 seconds by means of a double jet process. Subsequently, 2.5 g of potassium bromide was added thereto, and an aqueous solution containing 8.33 g of silver nitrate was then added thereto over a period of 26 minutes at such a rate that the flow rate at the time of completion of the addition was twice that at the time of the commencement of the addition.

Thereafter, 20 cc of a 25% ammonia solution and 10 cc of 50% $NH_4NO_3$ were added thereto, and the mixture was physically ripened for 20 minutes and neutralized by adding 240 cc of 1N sulfuric acid. Subsequently, an aqueous solution of 153.34 g of silver nitrate and an aqueous solution of potassium bromide were added thereto over a period of 40 minutes by means of a controlled double jet process while keeping the potential at a pAg of 8.2. The addition was made at such an accelerating rate that the flow rate at the time of completion of the addition was 9 times that at the time of the commencement of the addition. After completion of the addition, 15 cc of a 2N potassium thiocyanate solution was added thereto, and further 25 cc of a 1% aqueous solution of potassium iodide was added thereto over a period of 30 seconds.

The temperature of the emulsion was lowered to 35° C., and soluble salts were removed by a flocculation method. The temperature was raised to 40° C., and 30 g of gelatin and 2 g of phenol were added thereto. The pH and pAg were adjusted to 6.40 and 8.10, respectively by sodium hydroxide and potassium bromide.

After the temperature was elevated to 56° C., 600 mg of the following sensitizing dye and 150 mg of the following stabilizer were added thereto. After 10 minutes, 2.4 mg of sodium thiocyanate pentahydrate, 140 mg of potassium thiocyanate and 2.1 mg of chloroauric acid were added to each emulsion. After 80 minutes, the emulsion was quenched to solidify it, thus obtaining an emulsion. That emulsion had such a grain size distribution that 98% of the sum total of the projected areas of the entire grains was composed of grains having an aspect ratio of not lower than 3. With regard to all grains having an aspect ratio of not lower than 2, the average diameter (based on the projected area) was 1.4 μm, the standard deviation was 22%, the average thickness was 0.187 μm and aspect ratio was 7.5.

Sensitizing Dye

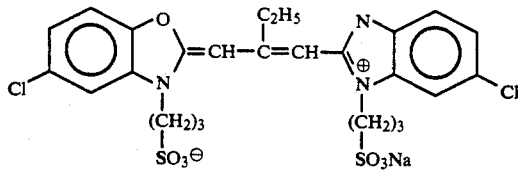

Stabilizer

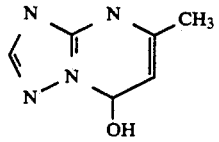

Preparation of Emulsion Coating Solution

The following reagents were added to the emulsion to prepare a coating solution, the amount of each reagent being per mol of silver halide:

| | |
|---|---|
| Gelatin added in such an amount as to give a ratio of silver/binder (gelatin + polymer) of 1.0. | |
| Water-soluble polyester (wt % based on the amount of gelatin) | 20% |
| Polymer latex (poly(ethyl acrylate/methacrylate acid) = 97/3) | 25.0 g |
| Hardening agent 1,2-Bis(sulfonylacetamido)ethane 8 mmol/100 g of gelatin of emulsion layer of surface protective layer | |
| Phenoxyethanol | 2 g |
| 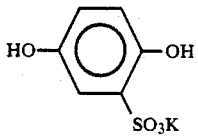 | 12 g/Ag · mol |
| 2,6-Bis(hydroxyamino)-4-diethylamino-1,3,5-triazine | 80 mg |
| Polysodium acrylate (average MW = 41,000) | 4.0 g |
| Polypotassium styrenesulfonate (average MW = 600,000) | 1.0 g |

The above coating solution and the coating solution for the surface protective layer were simultaneously coated on a transparent PET support of 175 μm in thickness to prepare each of the following Photographic Materials 501 to 505.

The total amount of silver coated on both sides was 3.2 g/m$^2$.

A coating solution for the surface protective layer was prepared by using the following components in the following amounts.

| Photographic Material | Compound No. |
|---|---|
| 501 (blank, Comp. Ex.) | — |
| 502 (Invention) | 1 |
| 503 (Invention) | 3 |
| 504 (Invention) | 4 |
| 505 (Invention) | 10 |

-continued

| Surface protective later | Coating weight (g/m$^2$) |
|---|---|
| Gelatin | 1.15 |
| Polyacrylamide (average MW = 45,000) | 0.25 |
| Polysodium acrylate (average MW = 400,000) | 0.02 |
| Sodium salt of p-t-octylphenoxy-diglycerylbutylsufonated material | 0.02 |
| Poly(degree of polymerization: 10)-oxyethylene cetyl ether | 0.035 |
| Poly(degree of polymerization: 10)-oxyethylene-poly(degree of polymerization: 3)oxyglyceryl-p-octylphenoxy ether | 0.01 |
| $C_8F_{17}SO_3K$ | 0.003 |
| $C_8F_{17}SO_2N(C_3H_7)(CH_2)_4(CH_2)_4SO_3Na$ | 0.001 |
| $C_8F_{17}SO_2N(C_3H_7)(CH_2CH_2O)_{10}(CH_2CHCH_2O)_4H$ | 0.003 |
| Proxel | 0.001 |
| Polymethyl methacrylate (average particle size: 3.5 μm) | 0.025 |
| Poly(methyl methacrylate/methacrylic acid) (molar ratio = 7:3, average particle size: 2.5 μm) | 0.020 |

Compounds 1, 3, 4, and 10 of the present invention were added to the Photographic Materials 502 to 505, respectively. Each of these compounds was used in an amount of $5\times10^{-4}$ mol per mol of silver halide.

(2) Preparation of Developing Solution

The formulations of concentrated liquid developers Part A, Part B, Part C and starter were as follows:

| | |
|---|---|
| Part A for 10 l | |
| Diethylenetriaminepentaacetic acid | 20 g |
| Potassium hydroxide | 291 g |
| Potassium sulfite | 442 g |
| Sodium hydrogencarbonate | 75 g |
| Boric acid | 10 g |
| Hydroquinone | 300 g |
| Diethylene glycol | 120 g |
| 5-Methylbenzotriazole | 0.2 g |
| Potassium bromide | 15 g |
| Water to make | 2.5 l |
| Part B for 10 l | |
| Triethylene glycol | 200 g |
| Glacial acetic acid | 40 g |
| 5-Nitroindazole | 2.5 g |
| 1-Phenyl-3-pyrazolidone | 15 g |
| Water to make | 250 ml |
| Part C for 10 l | |
| Glutaraldehyde (50 wt %) | 100 g |
| Sodium metabisulfite | 126 g |
| Water to make | 250 ml |
| Starter | |
| Glacial acetic acid | 150 g |
| Potassium bromide | 300 g |
| Water to make | 1.5 l |

The working solution was prepared in such a manner that 2.5 l of Part A, 250 ml of Part B and 250 ml of Part C. in order were dissolved in about 6 l of water with stirring. Finally, water was added thereto to make the solution 10 l, and the pH thereof was adjusted to 10.40. The resulting working solution was referred to as a developing replenisher. Twenty ml of the starter was added to 1 l of the replenisher. The resulting solution was the developing solution.

Fuji F (a product of Fuji Photo Film Co., Ltd.) was used for fixing.

The above-described Photographic Materials 501 to 505 were developed in the following manner by using a roller conveying type automatic processor (FPM-9000 manufactured by Fuji Photo Film Co., Ltd.).

The processing stages of 90 second processing and 45 second processing were as follows:

| Processing stage | Temp. (°C.) | Time (sec) | Replenishment rate |
|---|---|---|---|
| | 90 Second Processing | | |
| Development | 35 | 25 | 45 ml/10 × 12 in. |
| Fixing | 30 | 20 | 60 ml/10 × 12 in. |
| Rinsing | 20 | 11 | 3 l/1 min. |
| Squeeze drying | 50 | 34 | |
| Total | | 90 | |
| | 45 Second Processing | | |
| Development | 35 | 14 | 45 ml/10 × 12 in. |
| Fixing | 32 | 12 | 60 ml/10 × 12 in. |
| Rinsing | | 8 | 3 l/1 min. |
| Squeeze drying | | 11 | |
| Total | | 45 | |

The photographic characteristics are shown in the following table. Among the photographic characteristics, the fog value was measured as an increase in the net density obtained by correcting the density of the base. Gradation $\overline{G}$ represents the gradient of a straight line formed by joining a point of a density of (Fog+0.25) to a point of the density of (Fog+2.0). Sensitivity is determined by the relative value of the reciprocal of the exposure amount giving a blackening density of (Fog+0.1). Dm represents maximum density.

| Test No. | Photographic Material | Processing Time (sec) | Photographic Fog | $\overline{G}$ | Sensitivity | Dm |
|---|---|---|---|---|---|---|
| 1 (Comp. Ex.) | 501 | 90 | 0.04 | 2.85 | 100 | 3.40 |
| 2 (Comp. Ex.) | " | 45 | 0.03 | 2.50 | 65 | 3.10 |
| 3 (Invention) | 502 | " | 0.04 | 2.90 | 98 | 3.35 |
| 4 (Invention) | 503 | " | 0.04 | 2.87 | 101 | 3.41 |
| 5 (Invention) | 504 | " | 0.04 | 2.92 | 99 | 3.38 |
| 6 (Invention) | 505 | " | 0.04 | 2.89 | 99 | 3.43 |

It is apparent from the above table that when the compounds of the present invention are used, similar photographic characteristics to those obtained by the 90 second processing can be obtained in the 45 second processing wherein the processing time is shortened to ½. Further, image quality (graininess, sharpness) after development in the 45 second processing was substantially equal to that in the 90 second processing when visually evaluated.

It will be understood from the embodiments described above that the method of the present invention has the effect of accelerating development, provides good photographic characteristics and enables ultra-high-speed processing to be conducted. Further, good stability of the developing solution can be maintained, silver stain is not caused, and highly concentrated performance can be obtained.

While the invention has been described in detail and with reference to specific embodiments thereof, it is apparent to one skilled in the art that various changes and modifications can be made therein without departing from the spirit and scope of the present invention.

What is claimed is:

1. A method for the development of a silver halide light-sensitive material, wherein a silver halide light-sensitive material, which has been exposed to imaging radiation, is developed with a developing solution containing at least one compound represented by the following general formula (I):

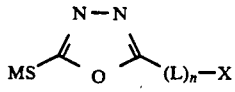

(I)

wherein M represents a hydrogen atom, an alkali metal atom, an ammonium group or a group which is cleaved under alkaline conditions; L represents a divalent organic group comprising an alkylene group, an alkenylene group, an ether group, a thioether group, —CO—, —CS— or —NR—, wherein R represents a hydrogen atom or an alkyl group, either alone or as a combination of two or more; X represents an amino group, a quaternary ammonium group, a hydroxyl group or a heterocyclic group; and n represents 0 or 1, wherein said developing solution contains a hydroquinone compound as a principal developing agent.

2. A method as in claim 1, wherein said silver halide light-sensitive material is a silver halide photographic material comprising a support having thereon at least one silver halide emulsion layer, and said emulsion layer or another constituent layer contains at least one compound represented by general formula (I).

3. A method as in claim 1, wherein said silver halide photographic material comprises a surface latent image silver halide emulsion.

4. A method as in claim 1, wherein said developing solution also contains a 3-pyrazolidone compound or a p-aminophenol compound.

5. A method as in claim 2, wherein the silver halide emulsion layer comprises tabular silver halide grains.

6. A method as in claim 5, wherein the tabular silver halide grains account for at least 80% by weight of the entire silver halide grains.

* * * * *